US008845068B2

(12) United States Patent
Kammerzell

(10) Patent No.: US 8,845,068 B2
(45) Date of Patent: Sep. 30, 2014

(54) PRINTHEAD ALIGNMENT EVALUATION

(71) Applicant: Hewlett-Packard Development Company, L.P., Houston, TX (US)

(72) Inventor: Barret Kammerzell, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 8 days.

(21) Appl. No.: 13/682,639

(22) Filed: Nov. 20, 2012

(65) Prior Publication Data

US 2014/0139583 A1 May 22, 2014

(51) Int. Cl.
*B41J 29/393* (2006.01)
*B41J 2/045* (2006.01)

(52) U.S. Cl.
CPC ..... *B41J 2/04505* (2013.01)
USPC ..... 347/19

(58) Field of Classification Search
CPC ..... B41J 29/393; B41J 2/2114; B41J 2/2135
USPC ..... 347/19
See application file for complete search history.

(56) References Cited

U.S. PATENT DOCUMENTS

| | | | | |
|---|---|---|---|---|
| 6,132,024 | A * | 10/2000 | Nelson et al. | 347/19 |
| 6,164,749 | A | 12/2000 | Williams | |
| 6,454,383 | B2 * | 9/2002 | Lund et al. | 347/19 |
| 6,552,820 | B1 | 4/2003 | Hill | |
| 7,198,349 | B2 | 4/2007 | Endo et al. | |
| 7,959,252 | B2 * | 6/2011 | Endo | 347/19 |

OTHER PUBLICATIONS

Bruijnen, D. et al.; Active Printhead Alignment for Wide Format Printing Systems, < http://ieeexplore.ieee.org/xpl/articleDetails.jsp?tp=&arnumber=4282241 > on pp. 1520-1525, Jul. 9-13, 2007.

* cited by examiner

*Primary Examiner* — Stephen Meier
*Assistant Examiner* — Alexander D Shenderov

(57) ABSTRACT

In one embodiment, a first reference pattern is caused to be printed with transparent ink ejected from a first printhead. A second reference pattern is caused to be printed, with a first colorant ink ejected from a second printhead, to least partially overlap the first reference pattern. The overlapping causes the second reference pattern to be visually discernible where the first and second reference patterns overlap. A background pattern, overlapping and surrounding the first and second reference patterns, is caused to be printed with a second colorant ink less dark than the first colorant ink. The printing of the background pattern causes the first reference pattern to be visually discernible where the first and second reference patterns do not overlap.

20 Claims, 4 Drawing Sheets

PRINTHEAD ALIGNMENT EVALUATION

BACKGROUND

The present disclosure relates to printers that utilize multiple printheads to eject ink or other marking material onto a printable media. In many printer configurations, print quality degrades if one or more of such printheads are not substantially aligned to their expected positions. One way to evaluate the alignment of printheads generally is to print a test pattern utilizing ink from each of the printheads to be evaluated. The actual positions of reference patterns within the test pattern can be compared to expected positions to evaluate printhead alignment.

BRIEF DESCRIPTION OF THE DRAWINGS

The accompanying drawings illustrate various embodiments and are a part of the specification. The illustrated embodiments are examples and do not limit the scope of the claims. Throughout the drawings, identical reference numbers designate similar, but not necessarily identical elements.

The same part numbers designate the same or similar parts throughout the figures.

DETAILED DESCRIPTION OF EMBODIMENTS

Figure 1:
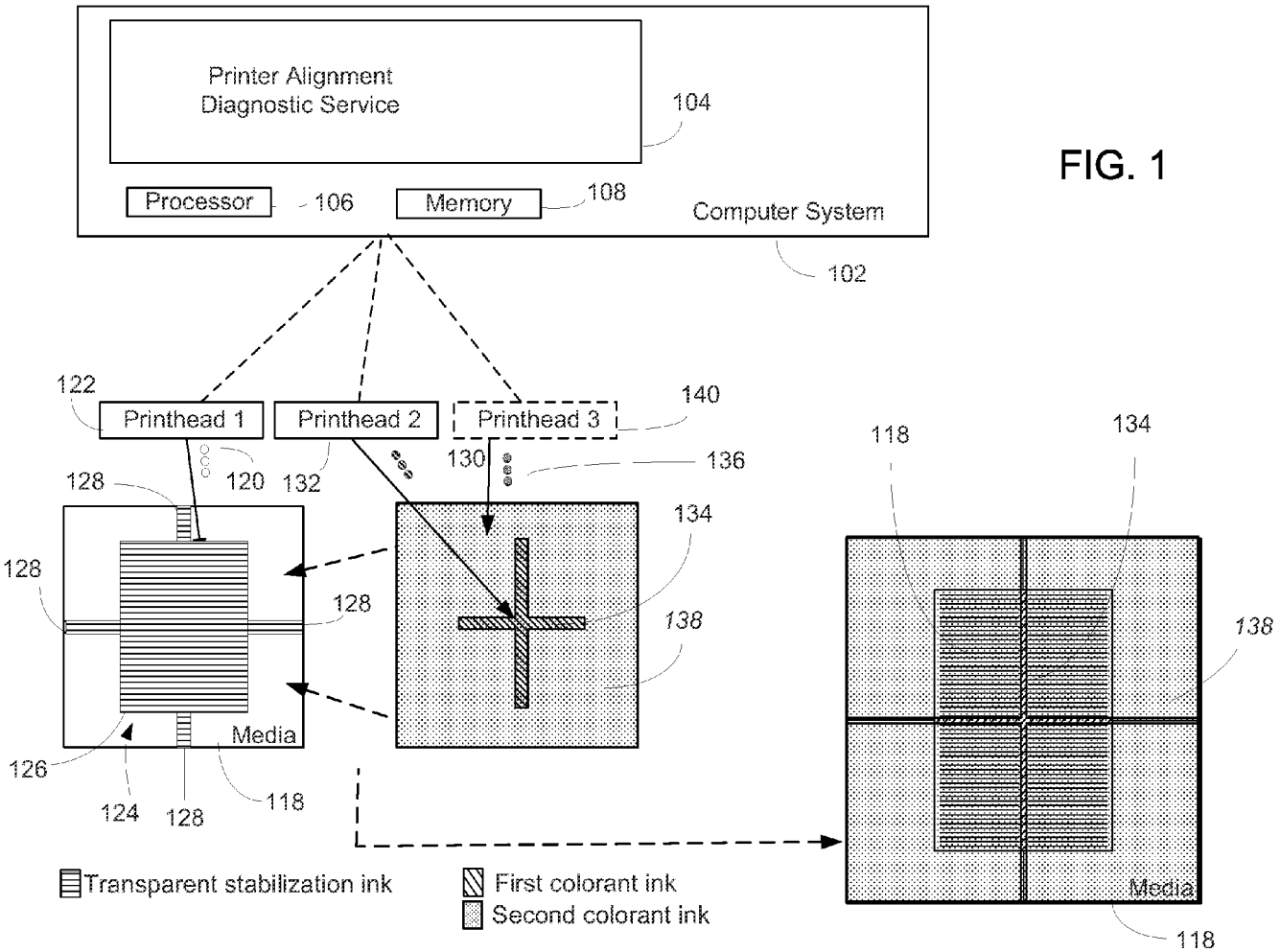
FIG. 1 illustrates a system to create a printhead alignment test pattern, according to various embodiments.

Many printers today utilize one or more printheads to apply colorant inks to a media, and also utilize one or more printheads to apply a transparent or nearly transparent pretreatment ink or other stabilization ink to stabilize the positions of the colorant ink drops. Just as accurate alignment of colorant printheads is important to ensure image quality, the accurate alignment of the transparent stabilization ink with respect to the colorant printheads is also important to avoid unacceptable defects such as bleed and coalescence of the colorant inks. However, because in many cases the stabilization ink cannot be seen directly with the human eye or even with the sensors in the printer, the printing and analysis of traditional test patterns will often be ineffective in determining the alignment of a printhead that ejects a transparent stabilization ink.

Accordingly, various embodiments described herein were developed to provide a method, a system, and a test pattern for printhead alignment evaluation. In an example, an alignment evaluation service executing upon a computing device causes printing, with transparent ink ejected from a first printhead, of a first reference pattern. The service additionally causes printing, with a first colorant ink ejected from a second printhead, of a second reference pattern. The second reference pattern at least partially overlaps the first reference pattern, with the overlapping causing the second reference pattern to be visually discernible where the first and second reference patterns overlap. The service additionally causes the printing, with a second colorant ink less dark than the first colorant ink, of a background pattern. The background pattern overlaps and surrounds the first and second reference patterns, such that the first reference pattern is visually discernible where the first and second reference patterns do not overlap.

Advantages of the disclosure include that the transparent stabilization ink will be clearly visible in the test pattern due to the application of the background layer, even if the printhead that ejects the transparent ink is severely misaligned from the colorant printheads. This design also ensures that the colorant reference patterns in the test pattern will be set in place without expanding or shifting position because the colorant reference patterns are printed over an area where the stabilization ink is heavily applied. Further, this disclosure minimizes the number of reference patterns or fiducials in the test pattern, thereby making it easier for the human eye to roughly evaluate the stabilization ink to black alignment without a microscope. Alternatively, the disclosed method, system, and test pattern can be evaluated utilizing a microscope or an optical sensing device in order to accurately measure the distance between the colorant ink reference patterns and transparent ink reference patterns. With this solution, customer satisfaction with printhead alignment test patterns, and with printers utilizing transparent stabilization inks, will increase.

As used in this application, a "printer" or "printing device" refers to any liquid inkjet printer, solid toner-based printer, liquid toner-based printer, or any other electronic device that prints. "Printer" or "printing device" includes any multifunctional electronic device that performs a function such as scanning and/or copying in addition to printing. A "printhead" refers to a mechanism having a plurality of nozzles through which ink or other fluid is ejected. Examples of printheads are drop on demand inkjet printheads, such as piezoelectric printheads and thermo resistive printheads. Some printheads may be part of a cartridge which also stores the fluid to be dispensed. Other printheads are standalone and are supplied with fluid by an off-axis fluid supply. "Ink" refers to any fluid that is to be applied to a media during a printing operation. "Ink" includes, but not limited to, aqueous inks, solvent inks, UV-curable inks, dye sublimation inks and latex inks. A "transparent ink" refers to ink that is clear, invisible, or substantially clear or substantially invisible so as to be indiscernible to a human eye or an optical sensor. A "colorant ink" refers to any ink that is visibly discernible and non-transparent, and may include inks that are black, white, or any other color that is visually discernible as applied to a media. A "stabilization ink" is a transparent ink applied to a media to cause colorant inks that are also applied to the media to be fixed on place, versus running or bleeding away from the position of application. A "reference pattern" is a marking or fiducial within a test pattern that can be utilized in the evaluation of alignment of printheads. A "database" refers to any organized collection of data in digital form such that it can be stored in computer memory or a data storage device.

FIG. 1 shows a first computer system 102, representing generally any computing device or group of computing devices configured to implement a printer alignment diagnostic service that causes printing of a test pattern for evaluation of printhead alignment. In an example, the first computer system 102 may be a server, desktop computer, notebook computer, tablet computer, smartphone, or any other computing device.

Computer system 102 is shown to include a printer alignment diagnostic service 102 ("PADS") 104, a processor 106, and a memory 108. The PADS 104 represents generally any combination of hardware and programming configured to cause printing of a test pattern for evaluating alignment of a colorant ink-ejecting printheads and transparent ink-ejecting printheads. Processor 106 represents generally any instruction execution system, such as a computer/processor based system or an ASIC (Application Specific Integrated Circuit), a computer, or other system that can fetch or obtain instructions or logic stored in memory 108 and execute the instructions or logic contained therein. Memory 108 represents generally any memory configured to store program instructions and other data. In this example, the computer system 102 is a computer system in electronic connection with a printing device. In another example, the computer system 102 may be a part of or included within a printing device.

In the example of FIG. 1, the PADS 104 causes printing upon a media 118, with transparent ink 120 ejected from a first printhead 122, a first reference pattern 124. In this example, the first reference pattern 124 includes a first rectangle 126 with four smaller rectangles 128 of equal dimensions, with each of the smaller rectangles 128 extending from a side of the first rectangle 126. In other examples, other patterns may be utilized.

The PADS 104 causes printing, with a first colorant ink 130 ejected from a second printhead 132, of a second reference pattern 134 at least partially overlapping the first reference pattern 124. This overlapping causes the second reference pattern 134 to be visually discernible where the first and second reference 124 134 reference patterns overlap. In one example, the first colorant ink is a black ink.

The PADS 104 causes the printing, with a second colorant ink 136 less dark than the first colorant ink 130, of a background pattern 138. In an example, the second colorant ink may be a cyan or a magenta colorant. In an example, the second colorant ink may be a mixture of cyan and magenta colorants. In yet another example, the second colorant ink may be a mixture of cyan, magenta, and black colorants. The background pattern 138 is printed to overlap and surround the first 124 and second 134 reference patterns, such that the first reference pattern 124 (printed with transparent stabilization ink 120) is visually discernible where the first 124 and second 134 reference patterns do not overlap.

The printing of the second reference pattern 134 to at least partially overlap the first reference pattern 124 causes the first colorant ink 132 within the second reference pattern 134 to stabilize substantially at the point of application, and thus not migrate or bleed into other portions of the media 118. Thus, in an example it is apparent where the first and second patterns 124 134 overlap because the first colorant ink 132 is fixed or stabilized. In an example, the fixing or stabilization of the second reference pattern 134, where the first and second reference patterns 124 134 overlap, causes the second reference pattern 134 to be visually discernible. In areas where there is no overlap between the first and second reference patterns 124 134, the first colorant 130 can blur or bleed such that the second reference pattern 134 is not visually discernible. The printing of the background pattern 138 to overlap and surround the first and second reference patterns 124 134 causes the transparent ink 120 in the first reference pattern 124 to be visually discernible in areas where the first and second reference patterns 124 134 do not overlap.

In the example of FIG. 1, the second colorant ink 136 is ejected to form the background pattern 138 after the printing of the first and second reference patterns 124 134. In another example, the second colorant ink 136 is ejected from a printhead to form the background pattern 138 before the printing of the first and second reference patterns 124 134.

In the example of FIG. 1 the transparent ink 120 that forms the first reference pattern 124 is ejected by a first printhead 122, the first colorant ink 130 that forms the second reference pattern 134 is ejected by a second printhead 132, and the second colorant ink 136 that forms the background 118 is ejected by a third printhead 140. In another example, a portion of the second colorant ink 136 may be ejected upon the media 118 by the second printhead 132. For instance, the second colorant ink 136 that is ejected onto the media 118 can be a mixture of ink ejected from the second printhead 132 and ink ejected from a third printhead 140. In yet another example, the second colorant ink 136 that is ejected is a mixture of colorant ejected from the second printhead 132, third printhead 140, and additional printheads.

The functions and operations described with respect to the PADS 104 and first computer system 102 may be implemented as a non-transitory computer-readable storage medium containing instructions executed by a processor (e.g., processor 106) and stored in a memory (e.g., memory 108). In a given implementation, processor 106 may represent multiple processors, and memory 108 may represent multiple memories. Processor 106 represents generally any instruction execution system, such as a computer/processor based system or an ASIC (Application Specific Integrated Circuit), a computer, or other system that can fetch or obtain instructions or logic stored in memory 108 and execute the instructions or logic contained therein. Memory 108 represents generally any memory configured to store program instructions and other data.

Figure 2B:
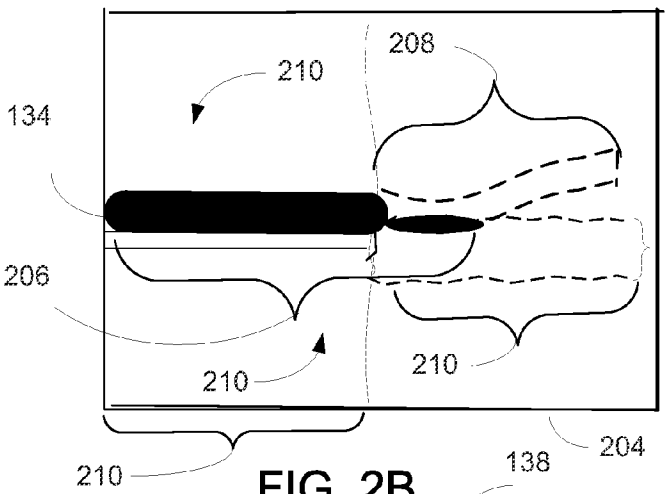
FIG. 2B illustrates a portion of the test pattern of FIG. 2A prior to the application of a background pattern, according to various embodiments.
Figure 2C:
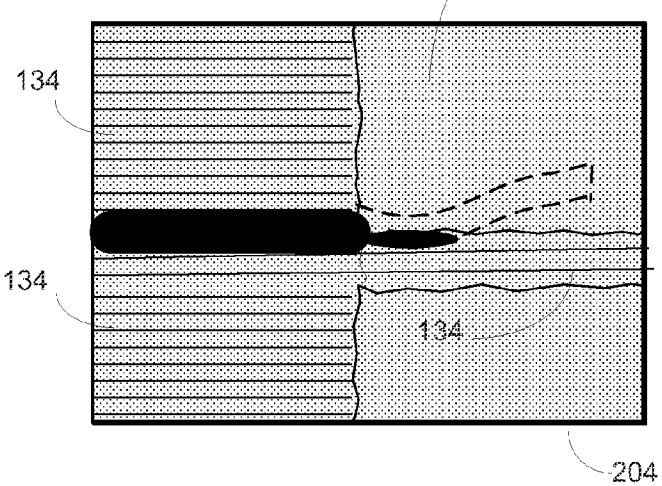
FIG. 2C illustrates a portion of the test pattern of FIG. 2A after the application of a background pattern, according to various embodiments.
Figure 2A:
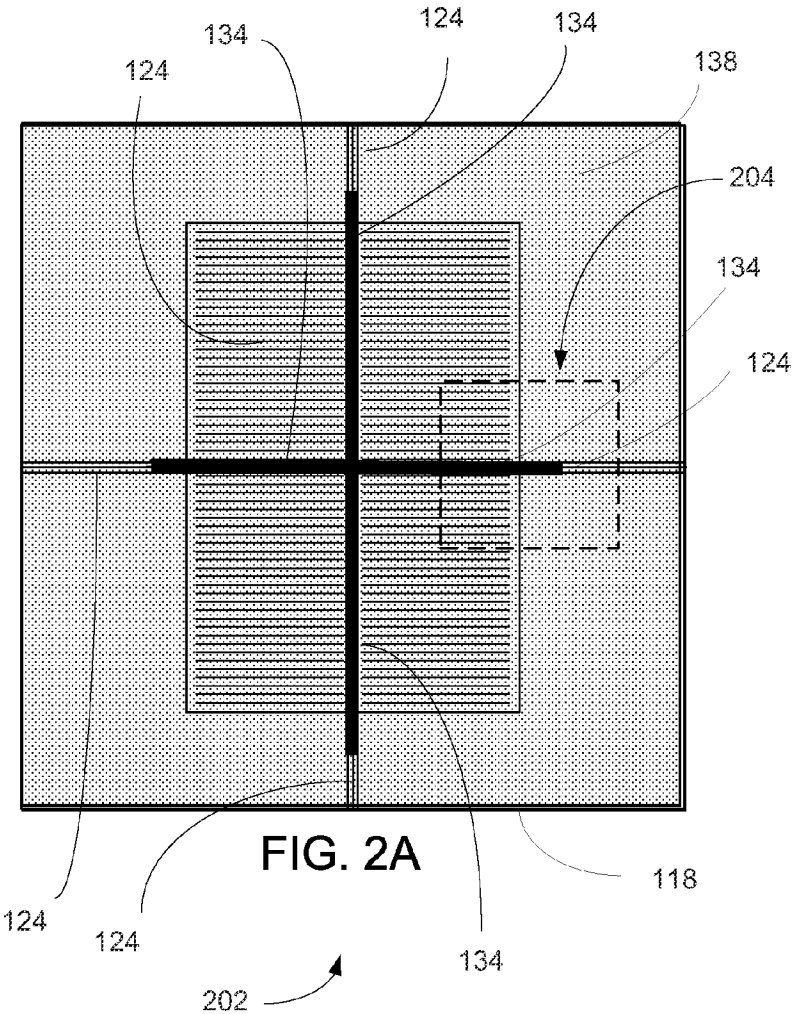
FIG. 2A illustrates a printhead alignment test pattern, according to various embodiments.

FIG. 2A illustrates a printhead alignment test pattern 202 created b the PADS 104 of FIG. 1. The first reference pattern 124 was applied to the media 118 with transparent ink 120, and the second reference pattern 134 was applied with the first colorant ink 132.

FIG. 2B illustrates a portion 204 of the test pattern of FIG. 2A prior to the application of a background pattern 138. FIG. 2B illustrates that the printing of the first reference pattern 124, and the printing of the second reference pattern 134 partially overlapping the first reference pattern 124 results in the second reference pattern 134 having a visually discernible area 206 (being discernible to a human eye or an optical sensor) and an indiscernible area 208. The discernible area 206 of the second reference pattern 134 is discernible because the first colorant ink 132 that was applied overlapping the first reference pattern 124 has been caused to stabilize or fix at the point of application, and thus not migrate or bleed into other portions of the media 118. Thus, the discernible area 206 of the first reference pattern 124 is discernible because of the overlap.

FIG. 2B also shows that, without the application of a background pattern, the transparent ink 120 of the first reference pattern 124 will not be visible in areas 210 where there is no overlap between the first and second reference patterns 124 134. The inability of a human or an optical sensing device to perceive the first colorant ink 130 of the second reference pattern 134, and the transparent ink 120 of the first reference pattern 124, in the areas 208 where there is no overlap of the first and second reference patters 124 134 can greatly reduce the effectiveness of test patterns for printhead alignment.

FIG. 2C illustrates the portion 204 of the test pattern of FIG. 2A after the application of a background pattern 138. The printing of the background pattern 138 to overlap and surround the first and second reference patterns 124 134 causes the transparent ink 120 in the first reference pattern 124 to be visually discernible even in areas that do not overlap with the second reference pattern 134. As a result of the printing of the background pattern 138, the first and second reference patterns 124 134 are more easily identified by the human eye or an optical sensing device.

Figures 3A, 3B:
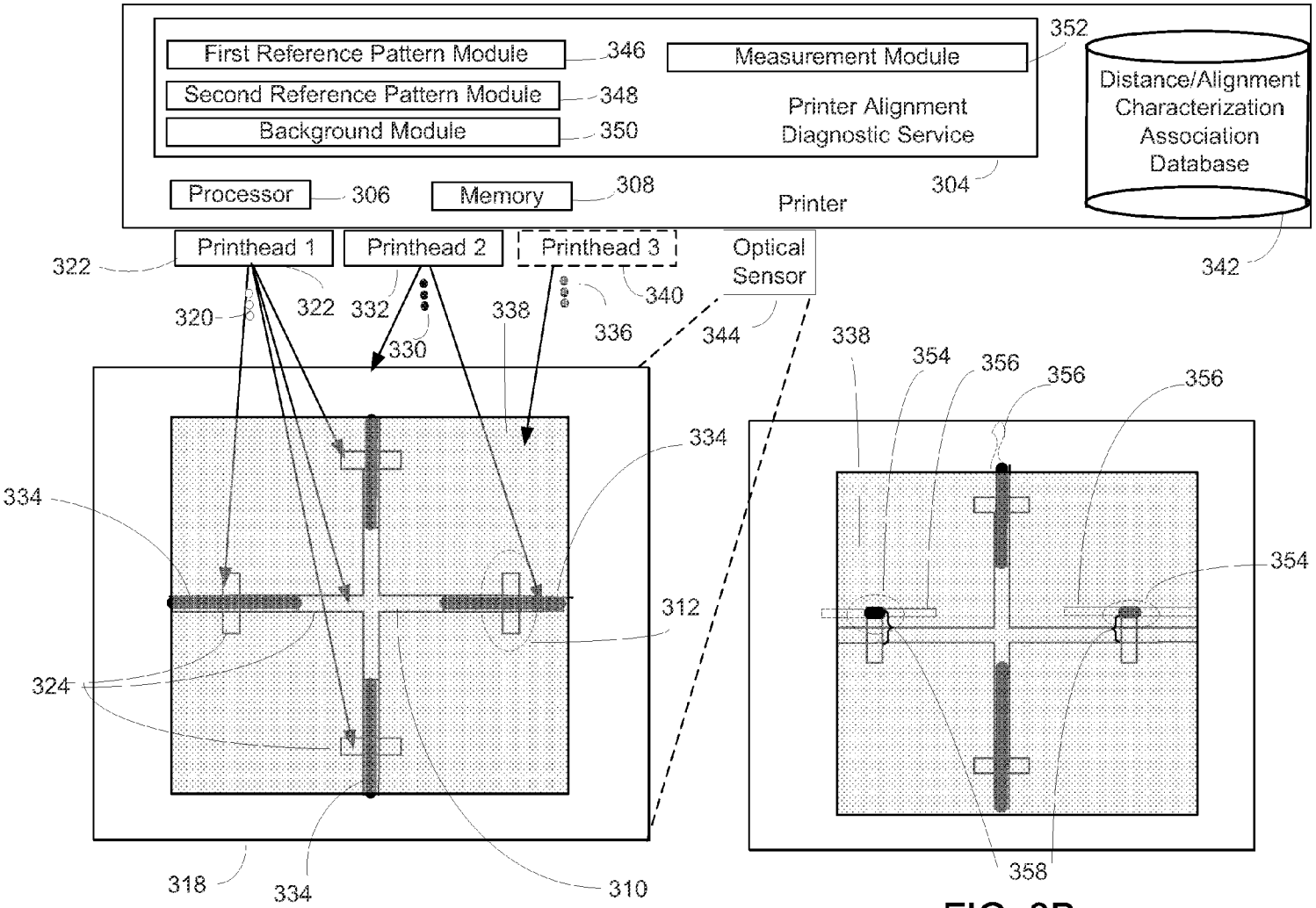
FIG. 3A illustrates a system to determine an amount of printhead misalignment, and a printhead alignment test pattern, according to various embodiments.
FIG. 3B illustrates a printhead alignment test pattern indicative of printhead misalignment, according to various embodiments.

FIG. 3A shows a first computer system 302, representing generally any computing device or group of computing devices configured to implement a printer alignment diagnostic service that causes printing of a test pattern for evaluation of printhead alignment. In an example, the first computer system 302 may be a server, desktop computer, notebook computer, tablet computer, smartphone, or any other computing device.

Computer system 302 is shown to include a printer alignment diagnostic service 302 ("PADS") 304, an association database 342, an optical sensor 344, processor 306, and a memory 308. The PADS 304 represents generally any combination of hardware and programming configured to cause printing of a test pattern for evaluating alignment of a non-transparent ink-ejecting printheads and transparent ink-ejecting printheads. The PADS 304 includes a first reference pattern module 346, a second reference pattern module 348, a background module 350, and a measurement module 352. The association database 342 represents generally a database that includes a plurality of test pattern measurements, and associates these test pattern measurements with characterizations describing the alignment of the printheads that were used to eject the inks that make up the test pattern. Optical sensor 344 represents generally any sensing device configured to detect brightness, luminosity, or another attribute of light reflected off a test pattern, and to convert a detected change in the detected attributes into an electronic signal that can be interpreted by an instrument or computer. Processor 306 represents generally any instruction execution system, such as a computer/processor based system or an ASIC (Application Specific Integrated Circuit), a computer, or other system that can fetch or obtain instructions or logic stored in memory 308 and execute the instructions or logic contained therein. Memory 308 represents generally any memory configured to store program instructions and other data. In this example, the computer system 302 is a computer system in electronic connection with a printing device. In another example, the computer system 302 may be a part of or included within a printing device.

In the example of FIG. 3A, the first reference pattern module 346 causes printing upon a media 318, with transparent ink 320 ejected from a first printhead 322, a first reference pattern 324. In this example, the first reference pattern 324 includes a crisscross pattern 310 with a "hammerhead" extension 312 feature at each appendage or end of the crisscross 310. In other examples of the first reference pattern, other patterns may be utilized.

The second reference pattern module 348 causes printing, with a first non-transparent ink 330 ejected from a second printhead 332, of a second reference pattern 334 at least partially superimposed with the first reference pattern 324. In the diagram of FIG. 3A, the second reference 334 pattern is printed with black ink, such that when the first and second printheads 322 332 are properly aligned, the second reference pattern 334 is printed superimposed over portions of the first reference patter 324. This superimposing causes the second reference pattern 334 to be visually perceptible where the first 324 and second reference 334 reference patterns superimpose.

The background module 350 causes the printing, with a second non-transparent ink 336 less dark than the first non-transparent ink 330, a background pattern 338. The background pattern 338 is printed to superimpose and surround the first 324 and second 334 reference patterns, such that the first reference pattern 324 (printed with transparent stabilization ink 320) will be visually perceptible where the first 324 and second 334 reference patterns do not superimpose.

FIG. 3B illustrates the test pattern of FIG. 3A, as it may be created when the first printhead 322 and second printhead 332 are not in proper alignment. When second reference pattern 334 (the black line) is printed to at least partially superimpose the first reference pattern 324 of transparent ink 322, the first non-transparent ink 332 within the second reference pattern 334 is caused to stabilize substantially at the point of application (versus migrating or bleeding into other portions of the media 318). The perceptible areas 354 illustrate that the first non-transparent ink 330 and the second reference pattern 334 are perceptible where the first and second patterns 324 334 superimpose because of the fixing or stabilization of the first non-transparent ink 332. FIG. 3B also illustrates how, in areas where the first and second reference patterns do not superimpose, the first non-transparent ink (black in FIGS. 3A and 3B) is diffused, migrated or blurred, and has bled into other portions of the media such that the second reference pattern 334 is not visible in such areas. FIG. 3B also illustrates that the fixing or stabilization of the second reference pattern 334, where the first and second reference patterns 324 334 superimpose, can causes the first reference pattern 324 to be visually perceptible. FIG. 3B also illustrates that the printing of the background pattern 338 to superimpose and surround the first and second reference patterns 324 334 causes the transparent ink 320 in the first reference pattern 324 to be visually perceptible in areas where the first and second reference patterns 324 334 do not superimpose.

Continuing with FIG. 3B, measurement module 352 causes the computer system 102 to utilize the optical sensor 344 to measure a distance 358 between a visually perceptible portion of the first reference pattern 324 and a visually perceptible portion of the second reference pattern 334. In an example, because of the application of the background 338 pattern to the test pattern, the entirety of the first reference pattern 324 may be perceptible to the optical sensor 344. In an example, the measurement module 352 compares the measured distance with association database 342 to determine an amount, if any, of misalignment as between printheads one and two 322 332 relative to the expected or optimal alignment positions for such printheads. The association database 342 contains data associating measured distances between the first and second reference patterns with characterizations of printhead alignment. In this example, the measurement module 352 then, determines an amount of printhead misalignment based on the comparison of a measurement made utilizing the optical sensor 344, and the distance/alignment association data included within the association database 342.

The functions and operations described with respect to the PADS 304 and first computer system 302 may be implemented as a non-transitory computer-readable storage medium containing instructions executed by a processor (e.g., processor 306) and stored in a memory (e.g., memory 308). In a given implementation, processor 306 may represent multiple processors, and memory 308 may represent multiple memories. Processor 306 represents generally any instruction execution system, such as a computer/processor based system or an ASIC (Application Specific Integrated Circuit), a computer, or other system that can fetch or obtain instructions or logic stored in memory 308 and execute the instructions or logic contained therein. Memory 308 represents generally any memory configured to store program instructions and other data.

Figure 4:
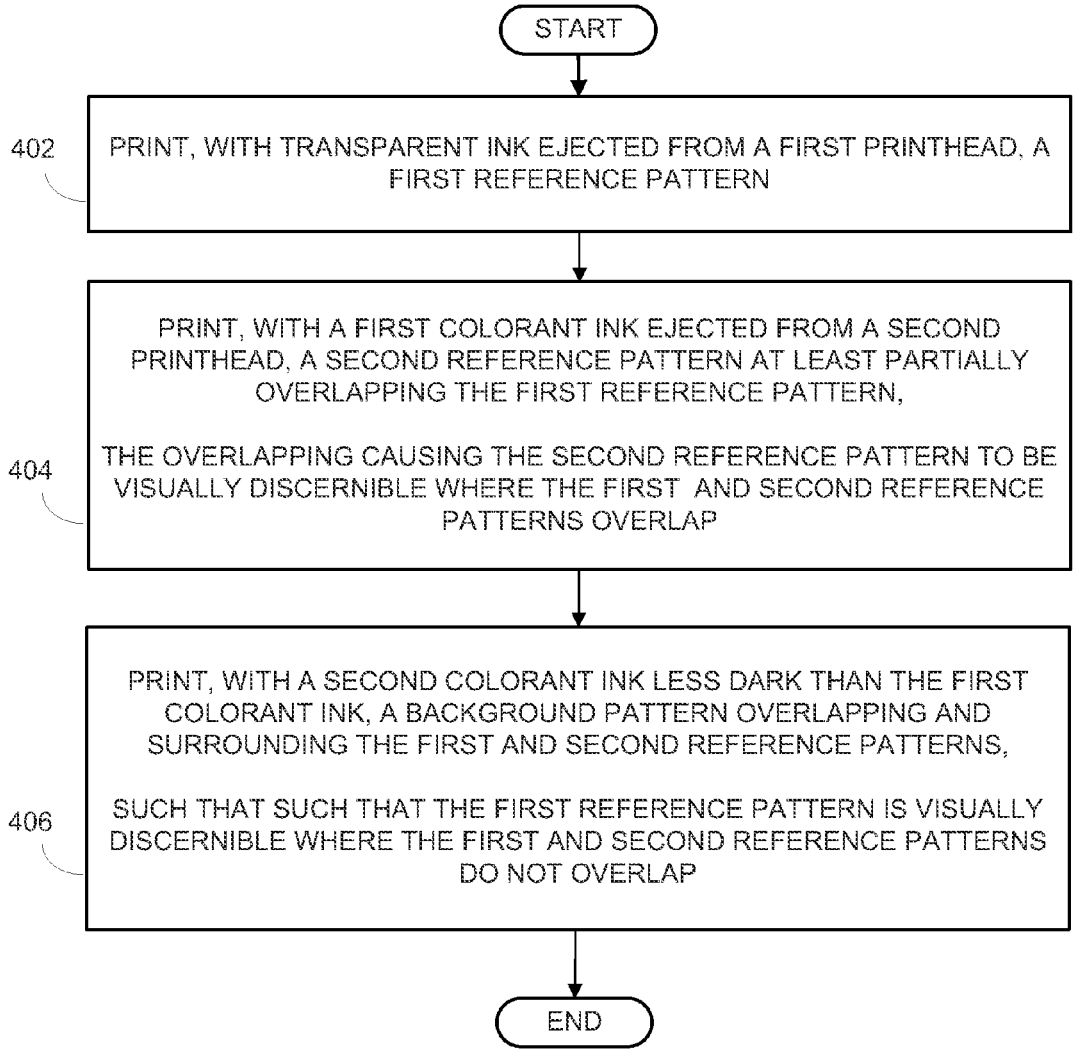
FIG. 4 is a flow diagram depicting steps taken to implement various embodiments.

FIG. 4 is a flow diagram of operation in a system according to various embodiments. In discussing FIG. 4, reference may be made to the diagram of FIG. 3A to provide contextual examples. Implementation, however, is not limited to those examples. Starting with FIG. 4, a first reference pattern is printed with transparent ink ejected from a first printhead (block 402). Referring back to FIG. 3A, first reference pattern module 346 may be responsible for implementing block 402.

Continuing with FIG. 4, a second reference pattern, at least partially overlapping the first reference pattern, is printed with a first colorant ink ejected from a second printhead. The overlapping causes the second reference pattern to be visually discernible where the first and second reference patterns overlap (block 404). Referring back to FIG. 3A, second reference pattern module 348 may be responsible for implementing block 404.

Continuing with FIG. 4, a background pattern, overlapping and surrounding the first and second reference patterns, is printed with a second colorant ink less dark than the first colorant ink. The printing of the background pattern causes the first reference pattern to be visually discernible where the first and second reference patterns do not overlap (block 406). Referring back to FIG. 3A, background module 350 may be responsible for implementing block 406.

Various modifications may be made to the disclosed embodiments and implementations without departing from their scope. Therefore, the illustrations and examples herein should be construed in an illustrative, and not a restrictive, sense.

What is claimed is:

1. A non-transitory computer-readable storage medium comprising instructions, the instructions when executed by a processor causing the processor to:

cause printing, with transparent ink ejected from a first printhead, of a first reference pattern;

cause printing, with a first colorant ink ejected from a second printhead, of a second reference pattern at least partially overlapping the first reference pattern, the overlapping causing the second reference pattern to be visually discernible where the first and second reference patterns overlap; and cause printing, with a second colorant ink less dark than the first colorant ink, of a background pattern overlapping and surrounding the first and second reference patterns, such that the first reference pattern is visually discernible where the first and second reference patterns do not overlap.

2. The medium of claim 1, wherein the printing of the second reference pattern at least partially overlapping the first reference pattern causes the first colorant ink within the second reference pattern to stabilize.

3. The medium of claim 1, wherein the printing of the background pattern overlapping and surrounding the first and second reference pattern causes the first colorant ink to stabilize in areas where the first and second reference patterns do not overlap.

4. The medium of claim 1, wherein the background is printed prior to the printing of the first and second reference patterns.

5. The medium of claim 1, wherein the background is printed after the first and second reference patterns.

6. The medium of claim 1, wherein the second colorant ink is ejected upon the media by a third printhead.

7. The medium of claim 1, wherein the second colorant ink is a mixture including ink ejected from the second printhead and ink ejected from a third printhead.

8. The medium of claim 1, wherein the instructions cause the processor to measure a distance between a visually discernible portion of the first reference pattern and a visually discernible portion of the second reference pattern.

9. The medium of claim 8, wherein the instructions cause the processor to compare the measured distance with a database associating measured distances with characterizations of printhead alignment, and determine an amount of printhead misalignment based on the comparison.

10. A system to evaluate alignment of a transparent ink printhead and non-transparent ink printhead, comprising:

a memory and a processor to execute instructions stored in the memory to implement modules, the modules comprising:

a first reference pattern module, configured to cause printing, with transparent ink ejected from a first printhead, of a first reference pattern;

a second reference pattern module, configured to cause printing, with a first non-transparent ink ejected from a second printhead, of a second reference pattern at least partially superimposing the first reference pattern, the superimposing causing the overlap of the first reference pattern and the second reference pattern to be optically perceptible; and a background module, configured to cause printing, with a second non-transparent ink less dark than the first non-transparent ink, of a background pattern superimposing and surrounding the first and second reference patterns, such that the first reference pattern is optically perceptible where the first and second reference patterns do not superimpose.

11. The system of claim 10, wherein the background is printed after the second reference pattern.

12. The system of claim 10, wherein the second colorant ink is a mixture including ink ejected from the second printhead and ink ejected from a third printhead.

13. The system of claim 10, wherein the printing of the second reference pattern at least partially superimposing the first reference pattern causes the first non-transparent ink within the second reference pattern to stabilize in the area of superimposing.

14. The system of claim 10, wherein the printing of the background pattern superimposing and surrounding the first and second reference pattern causes the first non-transparent ink to stabilize in areas where the first and second reference patterns do not superimpose.

15. The system of claim 10, further comprising a measurement module, configured to cause the processor to measure a distance between an optically perceptible portion of the first reference pattern and an optically perceptible portion of the second reference pattern.

16. The system of claim 15, wherein the measurement module causes the processor to compare the measured distance with a database associating measured distances with characterizations of printhead alignment, and determine an amount of printhead misalignment based on the comparison.

17. The system of claim 15, further comprising an optical sensor to measure the distance.

18. A printed test pattern for evaluation of alignment of a transparent ink printhead and colorant ink printhead, comprising:

a first reference pattern printed with transparent ink ejected from a first printhead;

a second reference pattern at least partially overlapping the first reference pattern, printed with a first colorant ink ejected from a second printhead, the overlapping causing the second reference pattern to be visually discernible where the first and second reference patterns overlap; and a background pattern, overlapping and surrounding the first and second reference patterns, printed with a second colorant ink less dark than the first colorant ink, such that the first reference pattern is visually discernible where the first and second reference patterns do not overlap.

19. The test pattern of claim 18, wherein the second pattern is printed with black ink.

20. The test pattern of claim 18, wherein the second pattern includes a crisscross shape.

* * * * *

UNITED STATES PATENT AND TRADEMARK OFFICE

CERTIFICATE OF CORRECTION

PATENT NO. : 8,845,068 B2
APPLICATION NO. : 13/682639
DATED : September 30, 2014
INVENTOR(S) : Barret Kammerzell It is certified that error appears in the above-identified patent and that said Letters Patent is hereby corrected as shown below:

In the Claims

In column 7, line 55, in Claim 3, delete “pattern” and insert -- patterns --, therefor.

In column 8, line 45, in Claim 14, delete “pattern” and insert -- patterns --, therefor.

Signed and Sealed this
Ninth Day of June, 2015

Michelle K. Lee

Michelle K. Lee
*Director of the United States Patent and Trademark Office*